US006627854B2

(12) United States Patent
Kumada et al.

(10) Patent No.: US 6,627,854 B2
(45) Date of Patent: Sep. 30, 2003

(54) HEATER AND GLOW PLUG

(75) Inventors: Chiaki Kumada, Gifu (JP); Naoto Terada, Aichi (JP); Shunsuke Goto, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/164,380

(22) Filed: Jun. 10, 2002

(65) Prior Publication Data

US 2002/0195436 A1 Dec. 26, 2002

(30) Foreign Application Priority Data

Jun. 11, 2001 (JP) ..... 2001-175378

(51) Int. Cl.[7] ..... F23Q 7/22

(52) U.S. Cl. ..... 219/270; 123/145 A; 313/141; 313/143

(58) Field of Search ..... 219/270, 544; 361/264, 265, 266; 123/145 A, 145 R, 143 C; 313/118, 141, 142, 143

(56) References Cited

U.S. PATENT DOCUMENTS 4,633,064 A * 12/1986 Atsumi et al. ..... 219/270
5,059,768 A * 10/1991 Hatanaka et al. ..... 219/270
5,118,921 A * 6/1992 Aota ..... 219/270
5,218,183 A * 6/1993 Kimata ..... 219/270
5,521,356 A * 5/1996 Bauer ..... 219/270
5,767,485 A * 6/1998 Kumada ..... 219/270
6,064,039 A * 5/2000 Kumada ..... 219/270
6,236,148 B1 * 5/2001 Nasu et al. ..... 313/141
6,420,683 B1 * 7/2002 Chiba et al. ..... 219/270
6,437,493 B2 * 8/2002 Nasu et al. ..... 313/141

FOREIGN PATENT DOCUMENTS

JP 10-2557 1/1998
JP 3039819 3/2000

* cited by examiner

*Primary Examiner*—Teresa Walberg
*Assistant Examiner*—Fadi H. Dahbour
(74) *Attorney, Agent, or Firm*—Sughrue Mion, PLLC

(57) ABSTRACT

A heater 1 has a seal structure formed by inserting a shaft-like member 4 into a stepped bore 8 formed in a tubular member 2, and setting an O-ring 16 on an upper surface of a stepped portion of the stepped bore 8, a clearance 15 between the shaft-like member 4 and tubular member 2 being thereby sealed with this seal structure. A seal region 17 is formed on the upper surface of the stepped portion of the stepped bore 8, and a conical introduction port portion 18 extending divergently in the rearward direction from the seal region toward an opening of the stepped bore 8 is provided. Moreover, a cone angle α of the introduction port portion 18 with respect to an axis L of the tubular member 2 is set to not larger than 35°.

10 Claims, 6 Drawing Sheets

HEATER AND GLOW PLUG

BACKGROUND OF THE INVENTION

1. Field of the Invention

The present invention relates to a heater for heating an object material, such as a gas, a liquid and the like, and to a glow plug for a diesel engine.

2. Description of the Related Art

A related art heater will be described on the basis of FIG. 6 of the accompanying drawings taking as an example the glow plug disclosed in Japanese Patent Laid-Open No. 10-2557. This glow plug 100 roughly includes a main metal member constituting a tubular member 101, a cap type sheath tube 102 fixed to a front end of the tubular member 101, and a central electrode constituting a shaft-like member 103. The shaft-like member 103 extends through the center of the tubular member 101 to reach the sheath tube 102, and a front end of the sheath tube 102 and that of the shaft-like member 103 are electrically connected to each other via a control coil 104 and a heating coil 105. A stepped bore 106 is formed in a rear end (upper portion of the drawing) of the tubular member 101, and an upper portion of the shaft-like member 103 is fixed in the center of the tubular member 101 by a bush type insulating ring 107 fitted in the stepped bore 106.

Thus, the glow plug 100 employs a seal structure having a clearance 108 between the surface of the tubular member 101 which defines the stepped bore 106 and the shaft-like member 103, an O-ring 109 being fitted in the clearance 108 and crushed by a stepped portion of the stepped bore 106 and the insulating ring 107, the clearance 108 being thereby closed.

3. Problem Solved by the Invention

When the O-ring 109 is inserted into the stepped bore 106 of the glow plug 100, there is the possibility that the O-ring 109 be broken or cracked, i.e., damaged. Especially, in recent years, the miniaturization of the glow plug 100 has progressed, and a glow plug in which a nominal diameter (diameter of a ridge) of a male thread 110 to be engaged with a diesel engine is not larger than 10 mm is being manufactured. In such a glow plug, a stepped bore 106 has a small diameter, and an O-ring 109 is extremely small, so that the O-ring is in great danger of being damaged. Needless to say, the damage to the O-ring 109 causes an imperfect sealing of the glow plug 100 and exerts a bad influence upon the performance thereof. Therefore, it becomes essential to visually inspect the O-ring after the O-ring is inserted into the stepped bore, and this renders it difficult to automate the O-ring setting operation.

SUMMARY OF THE INVENTION

The present invention has been made in view of the above-mentioned circumstances, and has as an object to provide a heater and a glow plug which have a seal structure adapted to seal with an O-ring a clearance between an inner surface of a stepped bore in a tubular member and an outer surface of a shaft-like member inserted into the stepped bore, and which are capable of reducing a rate of occurrence of damage to the O-ring during an O-ring setting operation.

The present invention (1) provides a heater having a seal structure formed by inserting a shaft-like member into a stepped bore made in a tubular member, and providing an O-ring on a stepped portion of the stepped bore so as to close a clearance between the shaft-like member and tubular member, wherein a seal region is formed on a stepped portion of the stepped bore, a conical introduction port portion extending divergently in the rearward direction from the seal region toward an opening of the stepped bore is formed, and a cone angle $\alpha$ of the introduction port portion with respect to the axis of the tubular member being set not larger than 35°.

When the introduction port portion of a cone angle of not larger than $\alpha$=35° is formed in the stepped bore as mentioned above, the O-ring is forced into the seal region as the O-ring is deformed slowly, so that the breakage and cracking of the O-ring rarely occur. When the cone angle $\alpha$ is set in the range of 10° to 20°, which structure will hereinafter be referred to as preferred aspect of the invention (2), a substantial rate of occurrence of damage to the O-ring of 0% can be attained. Preferably, the axial length of the introduction port portion is set to a level which permits the O-ring set in the introduction port portion, and not yet forced down, to be sunk by at least a half portion thereof into the introduction port portion, which structure will hereinafter be referred to as preferred aspect of the invention (3). This enables the O-ring to be smoothly forced into the stepped bore.

DETAILED DESCRIPTION OF THE PREFERRED EMBODIMENTS

Figure 1:
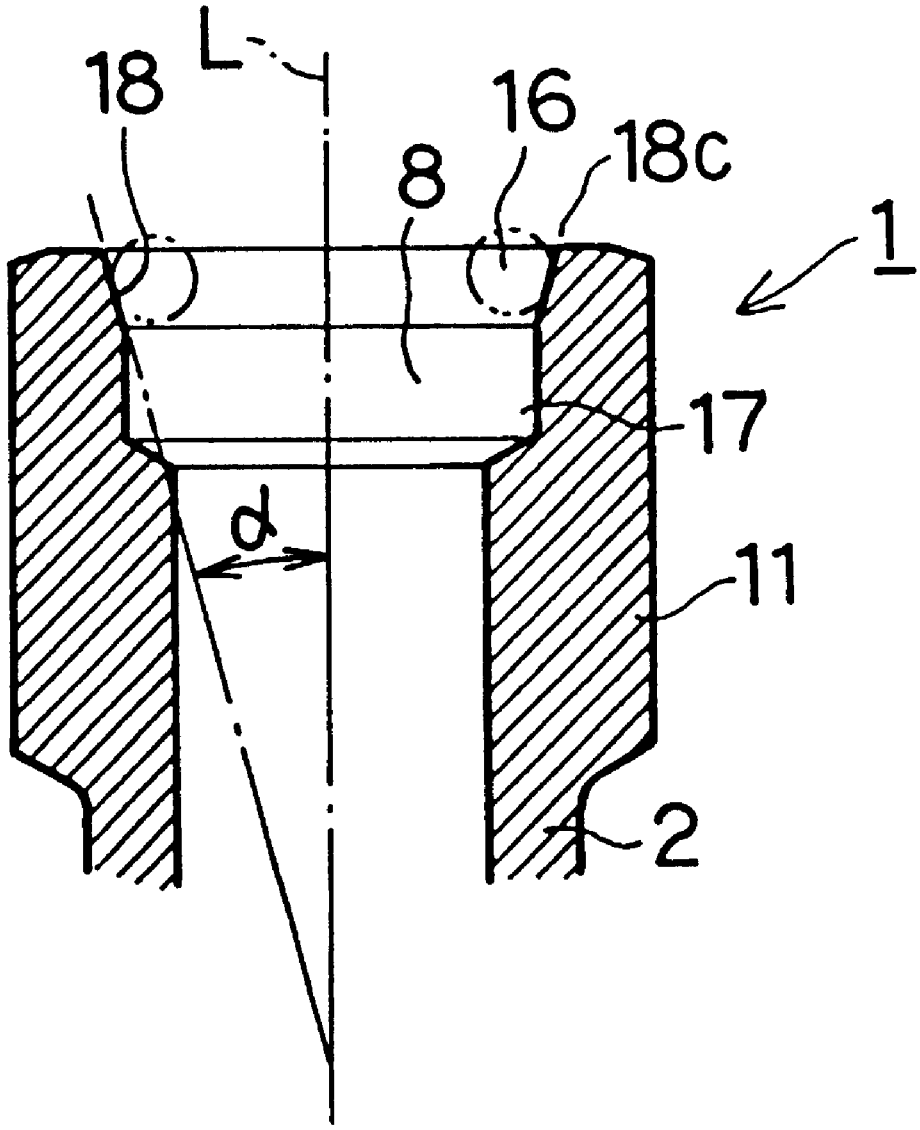
FIG. 1 is an enlarged sectional view of principal portion of an introduction port portion of a tubular member.
Figure 2:
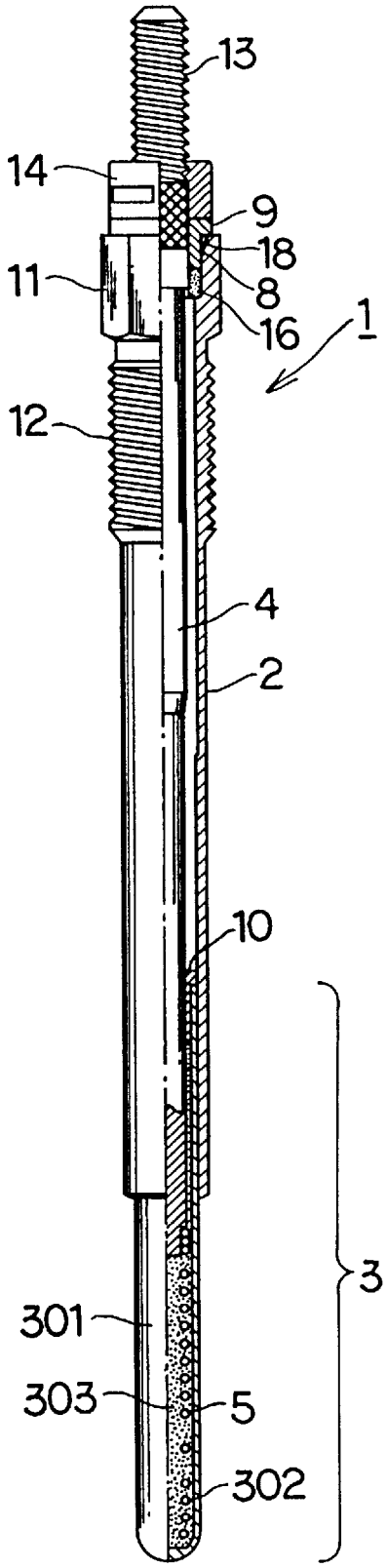
FIG. 2 is a front view of a glow plug with a right half portion thereof shown in section.
Figure 3:
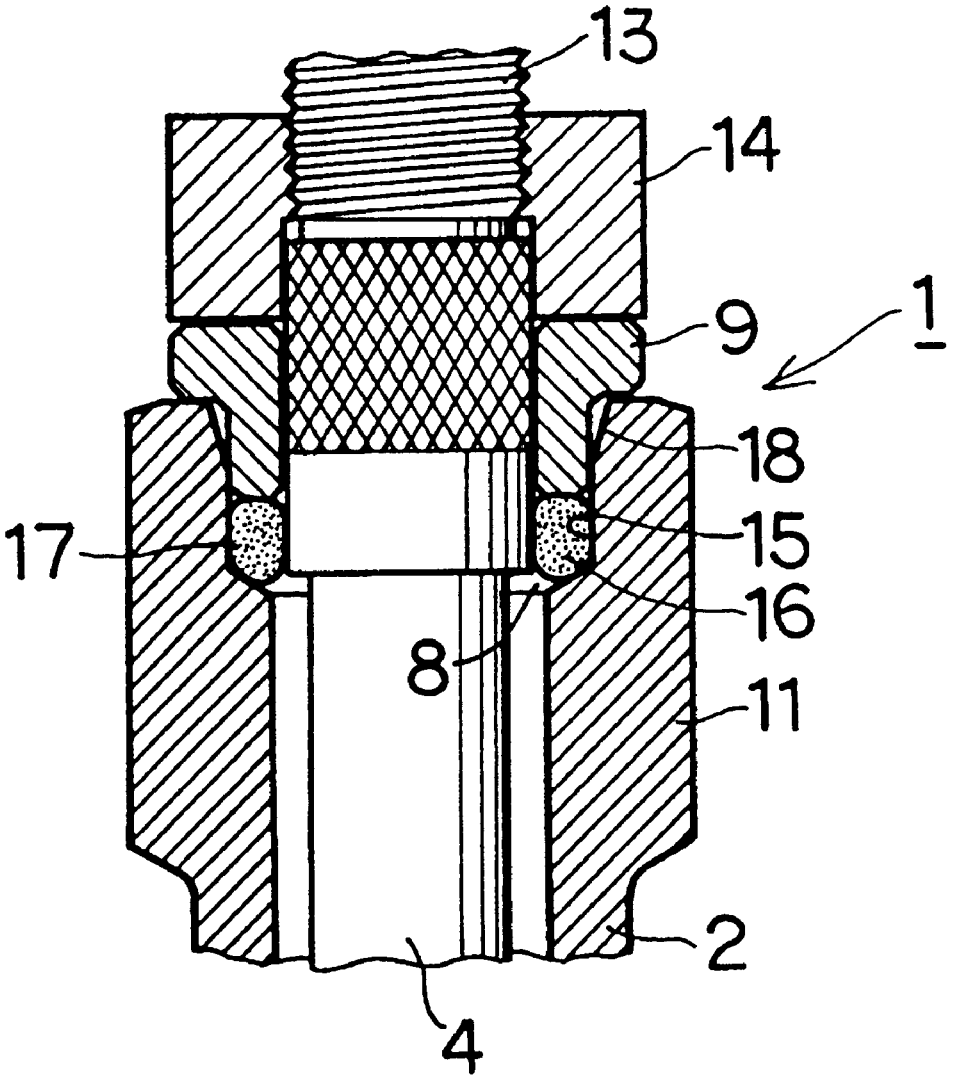
FIG. 3 is an enlarged sectional view of a principal portion of the glow plug.

A first mode of embodiment of the present invention will now be described with reference to FIGS. 1 to 3 with a glow plug illustrated as an example. FIG. 1 is an enlarged sectional view of a principal portion of a tubular member showing an introduction port portion, FIG. 2 a front view of the glow plug with a right half portion thereof shown in section, and FIG. 3 an enlarged view of a principal portion of the glow plug.

A glow plug 1 is roughly formed of a main metal member constituting a tubular member 2, a heating portion 3 fixed to a front end of the tubular member 2, and a central electrode constituting a shaft-like member 4. The heating portion 3 includes a sheath tube 301 obtained by forming a conductive metal to the shape of a cap, and a heating element 302 made of a conductive heating coil, the interior of the sheath tube 301 being packed with, for example, magnesia powder 303. The shaft-like member 4 extends through the center of the tubular member 2 to reach the sheath tube 301, and a front end of the shaft-like member and a tip of the sheath tube 301 are electrically connected together via a control coil 5 and a heating element 302.

In an upper end of the tubular member 2, a stepped bore 8 is formed. Owing to a bush type insulating ring 9 fitted in the stepped bore 8, an upper portion of the shaft-like member 4 is supported on the center of the tubular member 2, and joint portions of the two members 4, 2 are electrically insulated from each other. Between the shaft-like member 4 and sheath tube 301, a rubber packing 10 is fitted, by which the joint portions of the shaft-like member and sheath tube are electrically insulated from each other, and with which the sheath tube 301 is sealed.

A trunk portion at an upper end of the tubular member 2 is provided with a hexagonal bolt-shaped tool engaging section 11 on an outer circumference thereof, and a male thread 12 for fixing the glow plug to a diesel engine (not shown) is formed under the tool engaging section. The shaft-like member 4 is provided at a top portion thereof with a threaded section 13 to which a power source cable (not shown) is connected, and the insulating ring 9 is held firmly by a circular nut 14 screwed on the threaded section 13.

There is a clearance 15 between an inner surface of the stepped bore 8 of the tubular member 2 and an outer surface of the shaft-like member 4, and the clearance 15 is closed with an O-ring 16. Namely, the O-ring 16 of such a cross-sectional shape that has a width larger than that of the clearance 15 is fitted as shown in FIG. 3 in the same clearance between the inner surface of the stepped bore 8 of the tubular member 2 and outer surface of the shaft-like member 4, and held between a stepped portion of the stepped bore 8 and the insulating ring 9 to close the clearance 15.

Thus, the features of the present invention reside in the formation of a seal region 17 on the stepped portion of the stepped bore to a height necessary to have the O-ring provide a good seal, the formation of an introduction port portion 18 opened in the shape of a rearwardly divergent cone extending from the seal region toward an opening of the stepped bore 8, and the setting of a cone angle α (refer to FIG. 1) of the introduction port portion 18 with respect to the axis L of the tubular member 2 to not larger than 35°. In this structure, the axial length of the introduction port portion 18 is set to a level which permits the O-ring 16 set in the introduction port portion 18, and not yet forced down, to be sunk by at least a half portion thereof into the introduction port portion 18. In other words, when the O-ring 16 is set in the introduction port portion 18, and not yet forced down, less than half of the O-ring protrudes above the upper end of the tubular member 2. An edge 18*c* of an end of the opening of the introduction port portion 18 is chamfered for the purpose of preventing the O-ring 16 from being damaged.

A method of setting the O-ring in the introduction port portion will now be described. Before setting the O-ring 16, the shaft-like member 4 is inserted into and fixed in the tubular member 2. However, since the shaft member inserting and fixing step is carried out in the same manner as the corresponding step carried out in the production of a related art glow plug, a description thereof will be omitted.

First, the O-ring 16 and insulating ring 9 are fitted from an upper side around the shaft-like member 4 fixed to the tubular member 2, and the O-ring 16 is put in the seal region 17 of the stepped bore 8 as the O-ring is pressed down by the insulating ring 9. Since the portion of the O-ring the height of which is not smaller than a half of a total height thereof sinks naturally during this time into the opened end of the introduction port portion, the pressing of the O-ring into the stepped bore 8 can be started smoothly. The O-ring 16 is pressed by the insulating ring 9 and forced into the seal region 17 as the O-ring is deformed slowly along an inclined surface of the introduction port portion 18, so that the breakage of and cracks in the O-ring rarely occur. The O-ring 16 entering the seal region 17 closely contacts all of the inner circumference and upper surface of the stepped bore 8, the outer circumference of the shaft-like member 4 and a lower surface of the insulating ring 9 to completely close the clearance 15.

O-ring Setting Test:

In order to verify the effect of the present invention, glow plugs 1 in which the cone angles α of the introduction port portions 18 thereof were set to 45°, 35°, 25°, 20°, 10° and 5° were manufactured, and tests were conducted concerning the condition of the O-rings 16 already set in the seal region and the degree thereof. Concerning the stepped bore 8 and referring to FIG. 1, diameter of the seal region 17, the diameter of the opened end, and the depth measured from the opened end to the upper surface of the stepped portion of the stepped bore 8 were set to 6 mm (+0.1 mm to −0.05 mm), 6.7±0.1 and 2.8±0.2 mm, respectively. The diameter of the portion of the shaft-like member 4 which corresponds to the seal region 17 was set to 4 mm. The O-rings used in the tests were O-rings of 6.24 mm in outer diameter and 1.12 mm in diameter of a cross section thereof. These set levels correspond to those in the above-mentioned glow plug 1 having a nominal diameter of the male thread of 8 mm. The results of the tests are shown in Table 1. In Table 1, "X" indicates an imperfect seal and "○" indicates a good seal.

TABLE 1

Results of the O-ring Setting Tests:

| Cone angle α | Condition of O-ring: Breakage | Condition of O-ring: Cracking | Sealability |
|---|---|---|---|
| 45° | 5% | 12% | O |
| 35° | 1% | 5% | O |
| 25° | 0% | 2% | O |
| 20° | 0% | 0% | O |
| 10° | 0% | 0% | O |
| 5° | 0% | 0% | X |

As is clear from the results of these tests, the O-ring 16 was damaged with a high percentage of 17% when the cone angle was α=45° but, when the cone angle was α=35°, the rate of occurrence of damage to the O-ring greatly decreased. Furthermore, when the cone angle was not larger than α=20°, the rate of occurrence of damage became 0%. When the cone angle was α=5°, imperfect sealing of the glow plug occurred for the reason that the depth of the introduction port portion 18 increased to cause that of the seal region 17 to become short since the depth of the stepped bore 8 is limited. Therefore, in the case where, even when the depth of the stepped bore 8 is increased, a necessary seal region 17 can be secured, and a necessary sealability can be secured even when the cone angle is α=5° or not larger than α=5°.

Figure 5:
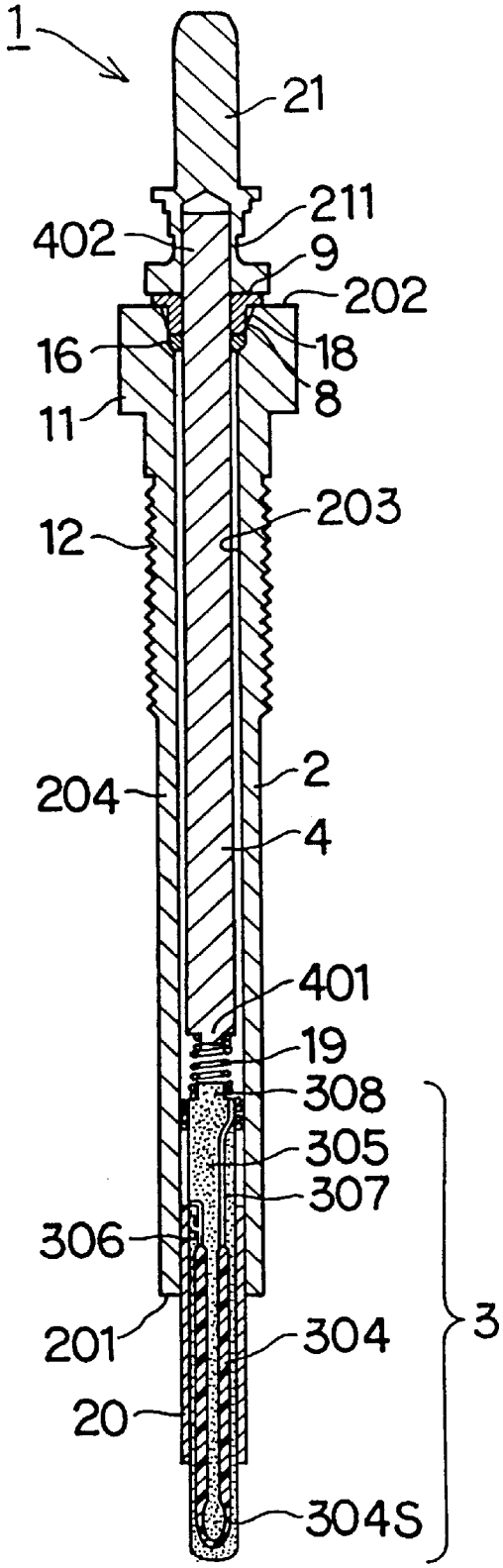
FIG. 5 is a longitudinal sectional view showing a second mode of embodiment of the glow plug.
Figure 6:
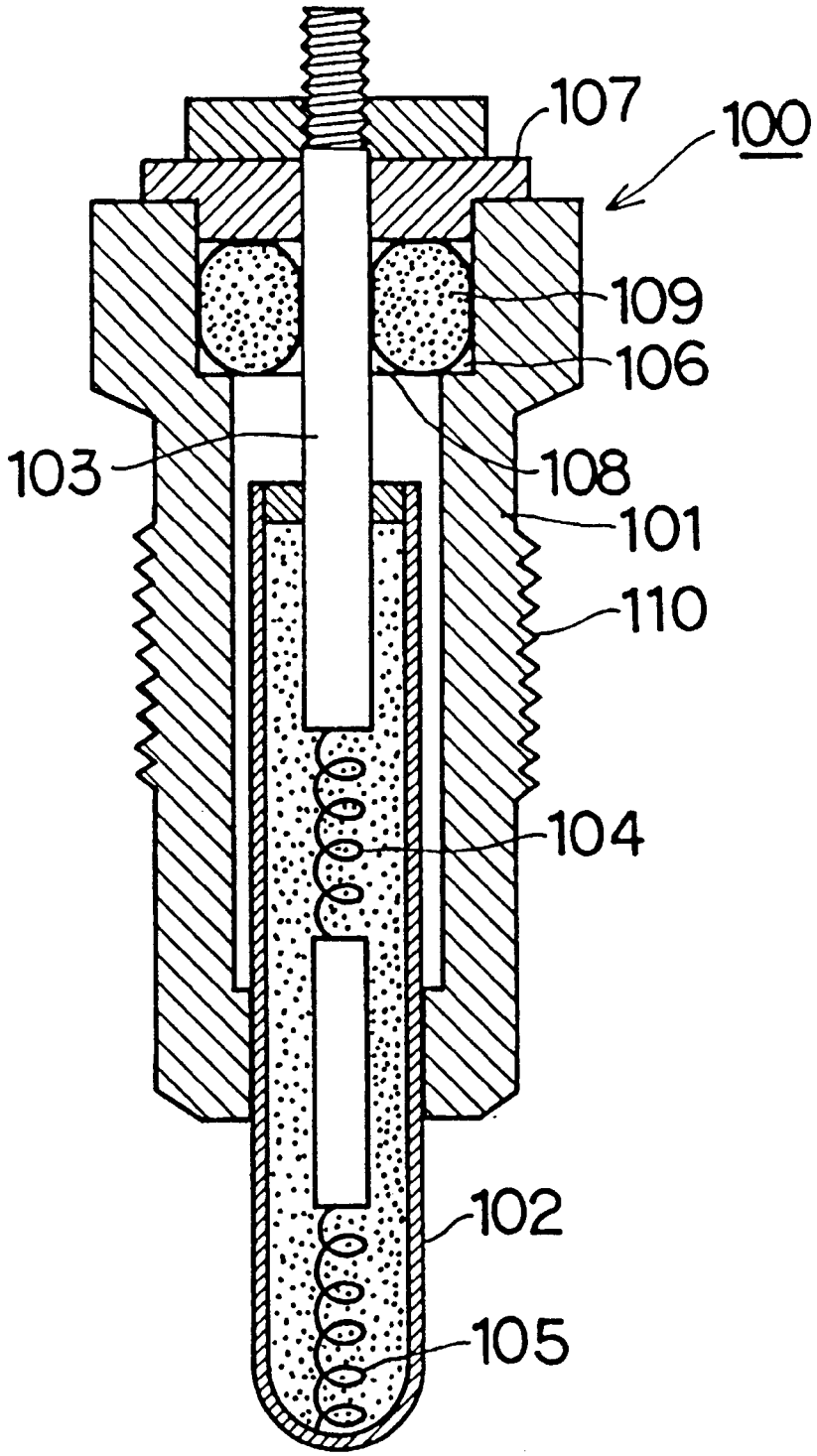
Fig. 6 (PRIOR ART)
FIG. 6 is a sectional view showing a related art glow plug.

A second mode of embodiment of the present invention will be described with reference to FIG. 5 showing a glow plug as an example. Regarding the parts having reference numerals as shown in FIG. 5 which are identical with those of the parts of the mode of embodiment 1, and which are not described below, a description thereof will be omitted in reference to the description of the corresponding parts of the mode 1 embodiment.

A tubular member (main metal member) 2 formed out of carbon steel has a through bore 203 extending axially between a front end 201 and a rear end 202 thereof. In this through bore 203, a heating portion 3, a rod-like shaft-like member 4 and a coiled lead 19 for connecting the heating portion and shaft-like member together are provided so that a front end side (lower end side in the drawing) of the heating portion 3 projects from the front end 201. A trunk portion 204 of the tubular member 2 is provided thereon with a male thread 12 of 10 mm in nominal diameter for fixing the glow plug to an engine and the like. A rear end portion of the tubular member 2 is provided with a hexagonal tool engaging section 11 for engaging a tool, such as a wrench and the like therewith.

The heating portion 3 is formed of a so-called ceramic heating element, which is formed by burying a heating element 304 made of a substantially U-shape conductive ceramic material containing WC or $MoSi_2$ as a main component in a base member 305 made of an insulating ceramic material containing silicon nitride as a main component; and drawing out both end of the heating element 304 to side portions thereof by drawer leads 306, 307 made of tungsten. A front end section 304S in the vicinity of a front end (lower end) of the heating element 304 is formed to a diameter smaller than that of the other portion thereof. When an electric current is applied to the heating portion, mainly this front end section 304S generates heat to cause the front end region of the heating portion 3 to generate heat.

The heating portion 3 is brazed to the tubular member 2 via an outer tube 20 brazed to the heating member 3 so as to surround the same. Owing to this arrangement, one end of the heating element 304 is electrically connected to the tubular member 2 via the drawer lead 306 and outer tube 20.

In the meantime, the other end of the heating element 304 is drawn out to a rear end section 308 by the drawer lead 307, and both the rear end section 308 and a front end portion 401 of the shaft-like member 4 are electrically connected together by the coil lead 19 formed by helically winding a leader line made of nickel.

The shaft-like member 4 formed out of an Fe material containing Fe as a main component projects from the rear end 202 of the tubular member 2 in the rearward direction (upward direction in the drawing), and is retained so that the shaft-like member neither contacts nor electrically communicates with the tubular member 2, by the O-ring 16, which is fitted from the rear end 202 in a clearance between the inner surface of the through bore 203 and the outer surface of the shaft-like member 4, and by the insulating ring 9, the air-tighness of this clearance is also maintained. In addition, a rear end portion 402 of the shaft-like member 4 is covered with the outer terminal 21 and caulked in the circumferential direction thereof to form a caulked portion 211, the outer terminal 21 and shaft-like member 4 being thereby fixed to each other in one body.

When a voltage is applied between the outer terminal 21 and tubular member 2 in this glow plug 1, an electric current flows from the outer terminal 21 to the tubular member 2 through the shaft-like member 4, coiled lead 19, drawer lead 307, heating element 304, drawer lead 306 and outer tube 20 to cause the front end section 304S of the heating element 304 to generate heat.

Figure 4:
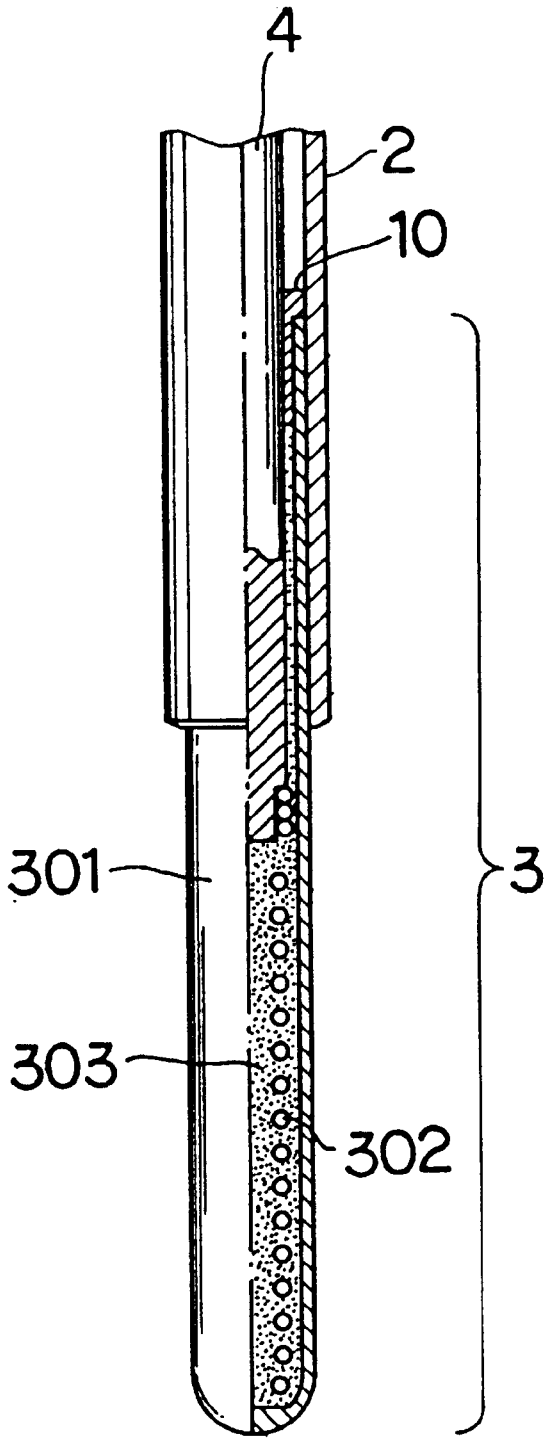
FIG. 4 is a partial enlarged sectional view showing another mode of heating portion of the glow plug.

The mode 1 and 2 embodiments of the present invention have been described above. The present invention is not, of course, limited to these embodiments. For example, in the mode 1 and 2 embodiments, a case is described where a heater is in the form of a glow plug 1. The present invention can be applied to any uses as long as an object apparatus is a water heater and the like adapted to heat an object material, such as a gas, a liquid, etc. Although the glow plug 1 shown in the mode 1 embodiment is a temperature self-control type glow plug in which the control coil 5 and heating coil 105 are connected together in series, the glow plug 1 shown in FIG. 4 which is not provided with the control coil 5 may also serve this purpose.

The heating portion 3 in the mode 2 embodiment was formed by burying the heating element 304 made of a conductive ceramic material in the base member 305 of an insulating ceramic material. This heating portion 3 may also be formed by burying the same heating element 302 of a heating coil as is referred to in the mode 1 embodiment in such a base member 305. The heating element 304 of a conductive ceramic material may be disposed so as to face onto a part (for example, the front end) of the surface of the base member 305.

In the heater or glow plug according to the present invention, an introduction port portion of a cone angle of not larger than $\alpha$=35° is formed in the stepped bore. Therefore, the O-ring is forced into the seal region as the O-ring is deformed slowly, so that the O-ring is not subject to damage. When the cone angle $\alpha$ is set to a level in the range of 10° to 20° as in preferred aspect of the invention (2) above, a substantial rate of occurrence of damage to the O-ring of 0% (no defects) can be attained. This enables the visual inspection of a just-set O-ring unnecessary, and automatic setting of the O-ring can be easily attained.

When the axial length of the introduction port portion is set to a level which permits the O-ring set in the introduction port portion and not yet forced down to be sunk by at least a half portion thereof into the introduction port portion as in preferred aspect of the invention (3) above, the forcing of the O-ring into the stepped bore can be started smoothly.

This effect is noticeable when the heater is utilized as a glow plug with the nominal diameter of the male thread for fixing the flow plug to an engine set not larger than 10 mm, and a more advantageous effect is displayed as this nominal diameter decreases to as small as not larger than 8 mm.

It should further be apparent to those skilled in the art that various changes in form and detail of the invention as shown and described above may be made. It is intended that such changes be included within the spirit and scope of the claims appended hereto.

This application is based on Japanese Patent Application No. 2001-175378 filed Jun. 11, 2001, incorporated herein by reference in its entirety.

What is claimed is:

1. A heater including a heating portion, said heater having a seal structure formed by inserting a shaft-like member into a stepped bore made in a tubular member, and providing an O-ring on a stepped portion of the stepped bore so as to close a clearance between the shaft-like member and said tubular member, wherein a seal region is formed on a stepped portion of the stepped bore, a conical introduction port portion is formed which extends divergently in the rearward direction from the seal region toward an opening of the stepped bore, and wherein a cone angle $\alpha$ of the introduction port portion with respect to an axis of the tubular member is not larger than 35°.

2. The heater according to claim 1, wherein the cone angle $\alpha$ is in the range of from 10° to 20°.

3. The heater according to claim 1, wherein the axial length of the introduction port portion is set to a level which permits the O-ring set in the introduction port portion, and not yet forced down, to be sunk by at least a half portion thereof into the introduction port portion.

4. The heater according to claim 1, wherein a heating portion of the heater comprises a ceramic material.

5. The heater according to claim 1, wherein the heating portion includes a sheath tube provided on a front end of the tubular member, and a heating element provided in the interior of the sheath tube.

6. The heater according to claim 4, wherein the heating portion includes a base member formed of an insulating ceramic material, and a heating element buried in the base member and formed of a conductive ceramic material.

7. The heater according to claim 4, wherein the heating portion includes a base member formed of an insulating ceramic material, and a heating element buried in the interior of the base member comprising a conductive heating coil.

8. The heater according to claim 4, wherein the heating portion includes a base member formed of an insulating ceramic material, and a heating element formed so as to face onto a part of a surface of the base member and made of a conductive ceramic material.

9. A glow plug comprising the heater according to claim 1, and a male thread having a nominal diameter of not larger than 10 mm for fixing the glow plug to an engine formed on an outer circumference of a trunk portion of the tubular member.

10. The glow plug according to claim 9, wherein the nominal diameter of the male thread is not larger than 8 mm.

* * * * *